United States Patent [19]

Mas et al.

[11] Patent Number: 4,628,949

[45] Date of Patent: Dec. 16, 1986

[54] DENTAL CLEANING COMPACT

[76] Inventors: Albert B. Mas; Christopher Mas, both of 43-29, 39th Pl., Sunnyside, L.I., N.Y. 11104

[21] Appl. No.: 733,793

[22] Filed: May 14, 1985

[51] Int. Cl.[4] ..... A45D 44/18

[52] U.S. Cl. ..... 132/84 R

[58] Field of Search ..... 132/84 R, 88.7

[56] References Cited

U.S. PATENT DOCUMENTS

| | | | |
|---|---|---|---|
| 2,002,144 | 5/1935 | Heaton | 132/88.7 |
| 2,702,041 | 2/1955 | McDougal et al. | 132/84 R |
| 2,921,590 | 1/1960 | Holton | 132/84 R |
| 2,968,827 | 1/1961 | Lawsine et al. | 132/84 R |
| 3,205,521 | 9/1965 | McCaughey et al. | 132/84 R |
| 3,905,113 | 9/1975 | Jacob | 132/84 R |
| 4,335,731 | 6/1982 | Bora, Jr. | 132/84 R |
| 4,344,535 | 8/1982 | Cagnazzi | 132/84 R |

FOREIGN PATENT DOCUMENTS

| | | | |
|---|---|---|---|
| 1457383 | 12/1968 | Fed. Rep. of Germany | 132/88.7 |
| 1511825 | 5/1978 | United Kingdom | 132/88.7 |

*Primary Examiner*—Hugh R. Chamblee

*Attorney, Agent, or Firm*—Chenpatents

[57] ABSTRACT

A toothbrush having a tapered tubular finger receptacle fits firmly on the user's fingertip. The toothbrush is stored in a compact case having an upper compartment for storage of the toothbrush, a lower compartment for storage of a solid bar of tooth or denture cleaning compound, and a hinged lid.

5 Claims, 6 Drawing Figures

DENTAL CLEANING COMPACT

BACKGROUND OF THE INVENTION

1. Field of Invention

This invention relates to a dental cleaning compact. Specifically, it relates to a compact containing a toothbrush and a dental cleaning compound in a case which conveniently fits into ladies' handbags or makeup kits, or into men's coat or shirt pockets.

2. Description of the Prior Art

Improved tooth or denture brushes in the prior art tend to be bulky. As a result, they are inconvenient to fit into small pockets and therefore are not used as often as would be desirable from a dental hygiene standpoint. U.S. Pat. No. 1,849,769 describes a tooth cleaning and polishing kit which takes up more room than a conventional toothbrush and tube of toothpaste. U.S. Pat. No. 1,962,337 provides a tooth powder receptacle with a storage compartment for a conventional toothbrush whose handle projects outward, making the toothbrush kit bulky and impractical to carry in a small pocket such as a shirt pocket or in a lady's makeup kit. U.S. Pat. No. 4,002,181 provides a toothbrush with a liquid denture cleaner reservoir which is both bulky and prone to leak.

Accordingly, there is a need for a truly compact kit containing a toothbrush and a tooth or denture cleaning compound which can be conveniently carried in small pockets making it practical to "brush after every meal."

SUMMARY OF THE INVENTION

The primary object of this invention is to provide a novel tooth or denture cleaning kit which is more compact than conventional toothbrushes and tubes of toothpaste as well as other improved toothbrushes in the prior art.

The dental cleaning compact of this invention comprises a toothbrush head attached to finger receptable which fits onto a finger, a solid bar of tooth or denture cleaning compound, and a case in which the toothbrush and tooth or denture cleaning compound are stored.

BRIEF DESCRIPTION OF THE DRAWINGS

FIG. 6 illustrates, in addition, the hinged lid in a partly open position.

DETAILED DESCRIPTION OF THE INVENTION

Figure 1:
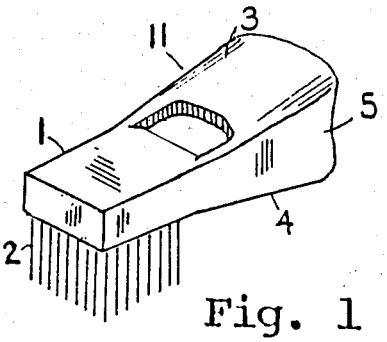
FIGS. 1 and 2 are perspective views from the front and the back, respectively, of the toothbrush and finger receptacle in accordance with this invention.
Figure 2:
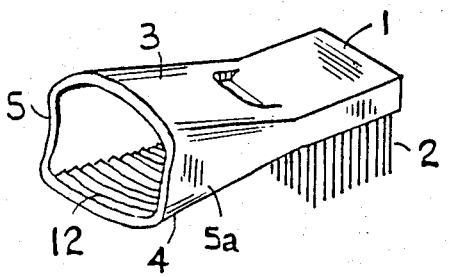
Figure 3:
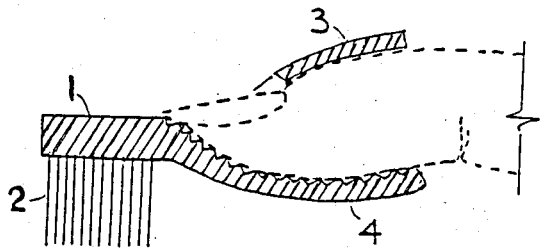
FIG. 3 is a side elevational, partly exploded, view of of the toothbrush illustrating the manner in which the finger receptacle fits onto a finger.
Figure 4:
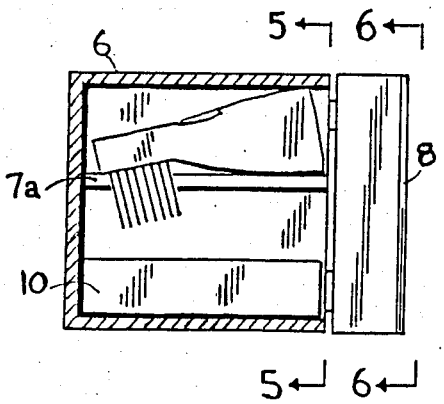
FIG. 4 is a side cross-sectional view taken along line 4—4 in FIG. 5 of the case and illustrates the manner in which the toothbrush and the bar of tooth or denture cleaning compound are stored in the case, with a hinged lid on the case partly open.
Figure 5:
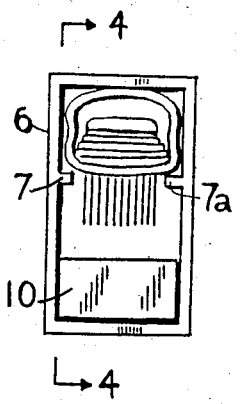
FIG. 5 is an end cross-sectional view taken along lines 5—5 in FIG. 4.
Figure 6:
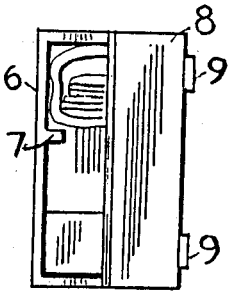
FIG. 6 is an end elevational view taken along line 6—6 in FIG. 4. Both drawings illustrate the storage of the toothbrush and the bar of tooth or denture cleaning compound in the case.

Referring to FIGS. 1–6, there is provided a toothbrush head comprising a bristle base 1 with bristles 2 embedded therein, a tapered tubular finger receptacle 11 integrally connected at its narrower end to one side of the bristle base 1. The finger receptacle comprises a lower panel 4, an upper panel 3, and two side panels 5 and **5*a* which are integrally connected along their lower edges to the lower panel 4 and along their upper edges to the upper panel 3**.

In accordance with the preferred embodiment of this invention, an aperture is provided at the end of the upper panel 3 adjacent to the bristle base 1 which permits fingernails to protrude beyond the end of the finger receptacle.

The lower panel 4 is preferably made of hard rubber or plastic and forms an integral part with the bristle base 1. The upper surface of the lower panel is provided with ridges 12 which produce friction when a finger is inserted into the finger receptacle and assure a firm grip.

The upper panel 3, preferably made of soft rubber, is connected along its lateral edges to the upper edges of the side panels 5 and **5*a*, which are made of elastic rubber sheet. These side panels are connected along their lower edges to the lateral edges of the lower panel 4**.

When a finger is inserted into the opening of the finger receptacle, the elastic side panels 5 and **5*a* are stretched, whereby they exert a downward pull on the upper panel 3, which presses the finger tip downwardly onto the ridged upper surface 12 of the lower panel 4**. A firm grip by the finger receptacle upon the finger tip is thereby assured.

With the toothbrush firmly on the index or middle finger, the user is able to use his/her finger to pick up dental cleaning compound on the bristles of the brush and to brush his/her teeth or dentures.

There is furthermore provided a rectangular case 6 open at one end with a lid 8 pivotally attached to the case by hinges 9. Two longitudinal ledges 7 and **7*a* project inwardly from the interior surfaces of the side walls of the case 6**. When the toothbrush is not in use, it is stored in the case in the space above these ledges in such manner that the finger receptacle and the bristle base rest on the upper surfaces of these ledges, while the bristles project downwardly through the space between the ledges.

At the bottom of the case below the ledges 7 and **7*a* there is provided a space in which a bar 10 of tooth or denture cleaning compound is stored. To pick up tooth or denture cleaning compound on the bristles of the toothbrush, the user wets the bristles of the toothbrush and inserts the toothbrush head into the space below the ledges 7 and 7*a*, thereby rubbing the bristles against the bar 10** of tooth or denture cleaning compound.

The approximate inside dimensions of the case 6 are as follows: height, $1\frac{1}{2}''$–$2''$; depth, $1\frac{1}{2}''$–$2''$; and width, $\frac{1}{2}''$–$1''$. The width of the ledges 7 and **7*a*** should be approximately $\frac{1}{8}''$–$\frac{1}{4}''$. To accommodate different finger sizes, several different sizes of finger receptacle and several case dimensions are provided.

The cleaning compound of which bar 10 is made may be either an abrasive denture cleaning compound or a less abrasive tooth cleaning compound.

While specific embodiments of a toothbrush and a dental cleaning compact are disclosed in the foregoing description, it will be understood that various modifications within the spirit of the invention may occur to those skilled in the art. Therefore, it is intended that no limitations be placed on the invention except as defined by the scope of the appended claims.

We claim:

1. A dental cleaning device comprising: a tapered tubular receptacle, integrally connected at its tapered end to one end of a toothbrush, said receptacle being formed of a lower panel of inflexible material, two side panels of elastic rubber and an upper panel of semi-flexible material; said upper panel having an aperture to accomodate the fingernail of a finger being inserted into the finger receptacle, and ridges being provided on the upper surface of the lower panel, whereby the side panels exert a downward pull on the upper panel, which thereby presses the fingertip downward on the ridged surface of the lower panel, thereby providing a firm grip by the finger receptacle on the finger tip.

2. A dental cleaning device of claim 1 wherein the inflexible material is hard rubber.

3. A dental cleaning device of claim 1 wherein the inflexible material is plastic.

4. A dental cleaning device of claim 1 wherein the semi-flexible material is a soft rubber.

5. A dental cleaning device of claim 1 further comprising a storage case having two spaced side walls, a top and bottom, one end wall, one hinged lid at the end opposite the end wall, two longitudinal ledges located opposite each other on the interior surface of the side walls, forming an upper compartment and a lower compartment; said dental cleaning device being disposed in the upper compartment and a bar of dental cleaning compound being disposed in the lower compartment.

* * * * *